United States Patent [19]

Duse

[11] 4,096,597

[45] Jun. 27, 1978

[54] DRAIN OPENING DEVICE

[76] Inventor: Gregory E. Duse, 7024 Hamilton Ave., Pittsburgh, Pa. 15208

[21] Appl. No.: 728,249

[22] Filed: Sep. 30, 1976

[51] Int. Cl.[2] ..... E03D 11/00; B65D 5/72; B65D 35/38

[52] U.S. Cl. ..... 4/255; 222/386.5; 222/494

[58] Field of Search ..... 4/255, 256, 257; 222/95, 193, 490, 105, 386.5, 494; 401/151, 193; 239/323, 328; 169/35

[56] References Cited

U.S. PATENT DOCUMENTS

| | | | |
|---|---|---|---|
| 1,869,483 | 8/1932 | Knapp et al. | 222/193 |
| 2,184,191 | 12/1939 | Lusk | 222/193 |
| 2,235,577 | 3/1941 | Evans | 169/35 X |
| 2,300,319 | 10/1942 | Smith | 4/255 |
| 2,336,592 | 12/1943 | Brown | 4/256 |
| 2,846,698 | 8/1958 | Tomlinson | 4/255 |
| 2,937,795 | 5/1960 | Ciliberti | 222/490 |
| 3,641,597 | 2/1972 | David et al. | 4/255 |
| 3,934,280 | 1/1976 | Tancredi | 4/255 |

*Primary Examiner*—Richard E. Aegerter
*Assistant Examiner*—Stuart S. Levy
*Attorney, Agent, or Firm*—Buell, Blenko & Ziesenheim

[57] ABSTRACT

An apparatus for opening clogged water drains by the force of a high speed water jet. The water is propelled by the manual operation of telescoping two cylinders together thereby reducing their volume. The water-filled cylinders are effectively sealed by the use of flexible plastic membrane.

1 Claim, 4 Drawing Figures

DRAIN OPENING DEVICE

This device relates to an apparatus for clearing clogged water drains. Water drains are usually clogged by a blockage of foreign matter in the trap area of the drain system. If this blockage is broken up into smaller pieces or forced through the trap, the system will again function properly. Many methods have been used to accomplish this end. These methods include chemical reactions with the foreign matter and forces exerted on the foreign matter. One of the methods of applying force to the foreign matter has been the usage of the water that is usually contained in the drainage system above the clogged area. This method of using water and its inherent incompressibility to apply the force to the clog has usually requires either a force cup plunger or a piston-type pump. The force cup method uses only a small volume of water to act on the clog. Piston pumps have been inherently complex and require complex piston seals. The present invention greatly simplifies the use of hydraulic forces to remove clogged drains.

An object of the present invention is to remove the clog in a blocked water drain by the use of positive hydraulic force and water flow. I provide for two coaxially mounted cylinders fitted together to allow them to telescope. One end of the telescoping cylinders is firmly closed and the other is provided with a pressure activated valve. An internally mounted flexible membrane provided for a water-tight seal between the cylinders. The telescoped cylinders can be filled with water through the pressure activated valve. When a force causes the cylinders to coaxially collapse, the water is forced through the pressure sensitive valve in the form of a high speed water jet.

The strength to withstand the internal water pressure is supplied by the rigid cylinders. The flexible membrane provides for an effective seal between the cylinders.

Additional objects and advantages will become apparent as the invention becomes better understood as reference to the continuing specification and drawings. In the accompanying drawings, we have shown a presently preferred embodiment of the invention in which.

Figure 1:
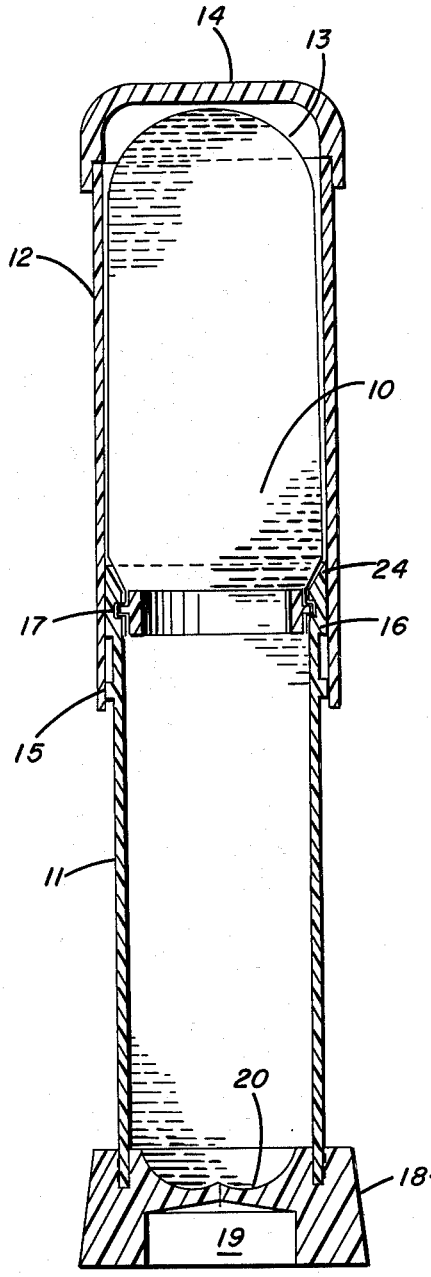
FIG. 1 is an elevational view of the drain opener shown in cross section with the cylinders telescoped and filled with water.

As shown in FIG. 1, the upper tube 12 is of a larger diameter than the lower tube 11. The tubes coaxially fit so that they freely slide in a telescoping fashion. Provisions have been made for a lower bearing ring 15 and an upper bearing ring 16 so that rigid support is given when the tubes are extended. The upper edge of the lower tube 11 has a tapered edge 24 to allow the flexible membrane 13 to be freely stripped from the interior walls of the upper tube 12. Securely mounted on the top of the upper tube 12 is a cap 14 which provides rigid support to the closed end of the flexible membrane 13. In actual construction, the cap 14 may be an integral part of the upper tube 12. The flexible membrane 13 therefore constitutes a closed chamber within the upper tube 12 with an opening through the retaining ring 17 into the lower tube 11. In actual construction, the flexible membrane 13 could be a plastic bag whose dimensions closely correspond to the interior dimension of the upper tube 12. Fixedly mounted on the bottom of the lower tube 11 is a base 18 which contains a pressure sensitive flap valve 20 and a water port 19.

The pressure sensitive valve 20 is designed to remain closed and watertight to small internal pressures. Once the pressure within the tubes is increased, the pressure sensitive or flap valve opens permitting a jet of water to flow from the tubes. The pressure sensitive valve 20 can be of any construction, but for efficiency and reuse it has been found that a flap valve functions best. This valve is constructed from a thin disk of rubber with a number of radius razor cuts through the disk. Constructing the flap valve 20 with an inward sloping conical bottom allows a higher pressure buildup inside the device before the valve opens. This sloping bottom also facilitates easy opening of the flap valve 20 inward to fill the device with water. The flap valve 20 can be made from any flexible material, especially plastic or rubber.

Figure 2:
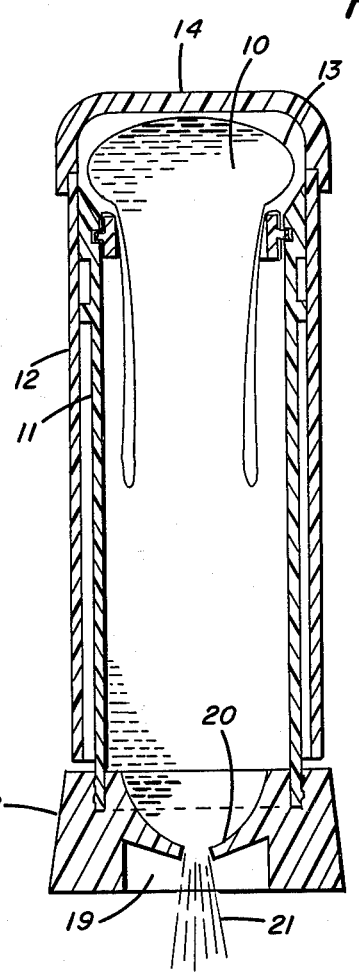
FIG. 2 is an elevational view shown in cross section with the cylinders collapsed and water jetting from the bottom.

FIG. 2 shows the drain opener as it is collapsed. The telescoping action of the tubes has reduced the interior volume by a factor of two. This displaced volume of water is used to forcibly remove the clog from the drain. The flap valve 20 has opened outwardly as the upper cylinder 12 has been forced downward.

The flexible membrane 13 has retracted as the volume within the cylinders has been reduced. During operation, the high pressure forces the flexible membrane 13 tightly against the inner surfaces of the tubes. Because the flexible membrane does not restrain the water pressure a very thin material can be used for its construction.

While FIG. 2 shows the flexible membrane 13 drawn into the lower tube 11, the membrane's final position during collapsing of the tubes depends upon its stiffness and flexibility. If thick plastic is used as a membrane, it may fold on itself as shown in FIG. 2. When the flexible membrane is made of a thin plastic or rubber, it will remain in the upper tube 12 or cap 14 when the tubes are collapsed. The important consideration in a choice of material for the flexible membrane is its strength to act as a seal between the tubes in the area of the upper edge 24. Additional considerations are its ability to easily strip from the interior surface of the upper tube during collapsing. Experimentation has shown that thin plastic bags have both the strength and durability to function properly.

The flexible membrane 13 is firmly sealed against the upper interior portion of the lower tube 11 by means of a retaining ring 17. With some materials, it is possible to bond the membrane 13 directly to the lower tube 11.

The base 20 is constructed of a molded rubber or other material that will deform to fit the contour of the drain thereby giving a watertight seal.

Figure 3:
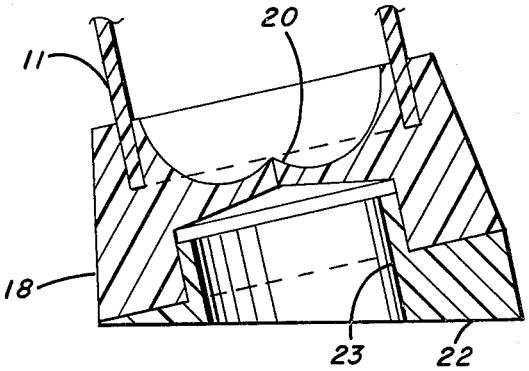
FIG. 3 is a partial elevational view shown in cross section with a wedge-shaped base.

FIG. 3 shows the drain opening device with the adapter wedge 22 inserted into the base 18. This wedge provides for operation of the device at an angle of 10° to 20° from a vertical. This angle allows use of the device on sinks that have overhanging water spouts, that is spigots, or other obstructions. The wedge 22 has an integral collar 23 that inserts into the water port 19 and allows the water jet to flow through the wedge into the drain. The wedge is constructed of the same material as the base 18.

Figure 4:
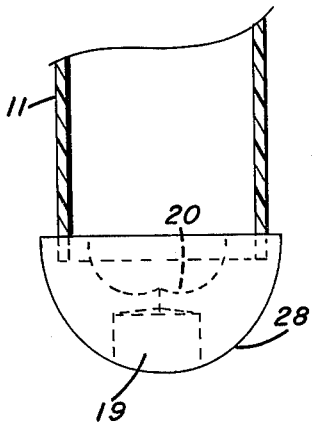
FIG. 4 is a partial elevational view shown in cross section with a spherical shaped base.

FIG. 4 shows the adaptation of a spherical base 28 with a water port 19 and pressure sensitive valve 20. The spherical base allows the device to be used with various size drains and in other than vertical positions.

In operations, the device is first inverted and filled with water. The pressure sensitive valve 20 can be opened by inserting the tip of the water spout or spigot into the water port 19 and exerting pressure on the valve 20. The device is filled with water thereby fully telescoping the upper tube 12 and filling the flexible membrane 13. The device is placed upright directly over the clogged drain. The sink would normally have standing water in the drain and bowl. The water remains in the device because of the action of the pressure sensitive valve 20. The base 18 is firmly seated over the drain opening. A firm continuing force is exerted on the upper tube 12 causng the tubes to collapse. As the tubes collapse internal pressure builds up causing the pressure valve 20 to open, and a high speed water jet 21 to enter the drain system.

While the present preferred embodiment uses two cylinders collapsing together any number of intermediate cylinders could be used to increase the ratio of volume displaced to volume remaining in the tubes. While the present embodiment uses circular cross-sectioned tubes, any cross-sectional shape could be used.

In the foregoing specification, I have set out certain preferred embodiments of my invention. However, it will be understood that this invention may otherwise be embodied within the scope of the following claims.

I claim:

1. An apparatus for opening clogged drains comprising:

(a) an upper tube having one closed end and one open end;

(b) a lower tube fitted coaxially within said upper tube to freely telescope;

(c) a flexible plastic bag the open end of which is attached within said lower tube and forming a watertight cavity within said upper tube;

(d) a base attached to the exposed end of said lower tube;

(e) a flap valve mounted in said base openable resiliently in response to fluid under pressure exerted on opposite sides thereof to permit passage of said fluid under pressure through said base in the direction of the applied pressure, (f) said base having a face normal to the axis of the said coaxial tubes and a recess in said face open to said flap valve; and (g) a separate member of elastomeric material removably fitted into said recess and having a face sloped at an angle of 10° to 20° to the face of said base.

* * * * *